US006293638B1

(12) United States Patent
McDonald

(10) Patent No.: US 6,293,638 B1
(45) **Date of Patent: *Sep. 25, 2001**

(54) BAR CODE PRINTING ON CARTONS WITH HOT MELT INK

(75) Inventor: Marlene M. McDonald, Enfield, NH (US)

(73) Assignee: Spectra, Inc., Keene, NH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/016,530

(22) Filed: Feb. 4, 1998

(51) Int. Cl.[7] ..... B41J 3/00; B41J 2/175; B41J 2/01

(52) U.S. Cl. ..... 347/4; 347/88; 347/102; 347/107

(58) Field of Search ..... 347/4, 88, 102, 347/103, 105, 107

(56) References Cited

U.S. PATENT DOCUMENTS

| | | | | |
|---|---|---|---|---|
| 3,875,574 | * | 4/1975 | Stone | 347/107 |
| 4,769,650 | * | 9/1988 | Peng et al. | 347/4 |
| 5,208,605 | * | 5/1993 | Drake | 347/15 |
| 5,262,804 | * | 11/1993 | Petigrew et al. | 347/54 |
| 5,467,709 | * | 11/1995 | Salomon | 101/93 |
| 5,489,925 | * | 2/1996 | Brooks et al. | 347/6 |
| 5,793,329 | * | 8/1998 | Okada | 101/488 |
| 5,801,722 | * | 9/1998 | Ueda et al. | 347/16 |
| 5,841,954 | * | 11/1998 | Ackley | 395/108 |
| 6,014,501 | * | 1/2000 | Fucuda et al. | 359/114 |
| 6,099,108 | * | 8/2000 | Weber et al. | 347/43 |

FOREIGN PATENT DOCUMENTS

| | | | | |
|---|---|---|---|---|
| 0372229 | | 6/1990 | (EP) . | |
| 2 142 579 | * | 1/1985 | (GB) . | |
| 2131767 | | 6/1987 | (GB) . | |
| 405031891 | * | 2/1993 | (JP) | 347/102 |
| 5-31891 | * | 2/1993 | (JP) | 347/102 |

OTHER PUBLICATIONS

PTO–1472 Indicating Bar Code Printed By HP Laserjet 5L Printer, Mar. 1995.*

European Patent Office Supplementary Search Report mailed Mar. 1, 2000 in European application No. EP98953638.

* cited by examiner

*Primary Examiner*—N. Le
*Assistant Examiner*—Shih-wen Hsieh
(74) *Attorney, Agent, or Firm*—Baker Botts, LLP

(57) ABSTRACT

In the method and apparatus for printing bar codes on cartons disclosed in the specification, cartons on which bar codes are to be printed are conveyed in succession in either direction past a heater which heats a selected portion of the carton surface and a hot melt ink jet printer which prints a bar code on the heater portion of the bar code surface. The carton surface portion is heated to a temperature which is above ambient temperature by an amount which is equal to about 40% to 100% of the difference between ambient temperature and the solidification temperature of the hot melt ink.

22 Claims, 1 Drawing Sheet

BAR CODE PRINTING ON CARTONS WITH HOT MELT INK

BACKGROUND OF THE INVENTION

This invention relates to printing of bar codes on self-supporting substrates such as cartons or boxes using hot melt ink.

In order to detect information recorded in conventional bar codes accurately, each bar in the bar code should be completely black and the edges of each bar should be well defined. In low resolution ink jet printing systems using hot melt ink, however, ink drops are deposited on a substrate in spaced relation and freeze upon contact to produce a pixel pattern in which the ink dot representing each pixel is usually separated from adjacent dots so as to leave a space between them. At low resolution i.e., about 200 dots per inch (dpi) using black ink, and spaces between ink dots are normally detectable by the human eye and provide an overall gray appearance for areas intended to be solid black. As a result, automatic detection of the bars in a bar code may be erratic.

While liquid ink applied to a fiber substrate tends to spread and fill blank spaces between the locations of the drops, it also causes bleeding which produces raggedness of the edges of the bars in a bar code, interfering with the detection of spaces between the bars. Such bar code detection problems may be significantly reduced or eliminated by using high resolution ink jet printers, but high resolution ink jet printers are available only at substantially increased cost in comparison with low resolution ink jet printers.

Heretofore, solid coverage of hot melt ink images printed on a thin substrate such as paper has been improved by heating the platen on which the paper is supported during printing to cause the hot melt ink drops to flow and coalesce as described, for example, in U.S. Pat. Nos. 4,751,528 and 4,951,067, or by passing a paper substrate on which a hot melt ink image has previously been formed through a heating unit as described, for example, in U.S. Pat. Nos. 4,971,408 and 5,281,442. Such procedures, however, are not possible where a bar code is printed on a self-supporting surface such as a surface of a carton or box which cannot be placed on a heated platen or otherwise heated from behind the surface on which the bar code is printed.

Normally, the ink drops from a low resolution hot melt ink jet printer printing a bar code on a box or carton solidify substantially on impact with the carton, providing ink spots about 0.003 inch in diameter which are spaced by about 0.005 inch. While the spacing of the drops in the scanning direction can be reduced by moving the carton past the printer more slowly or by increasing the rate of drop ejection, such small drop sizes with low resolution ink jet printers leave substantial blank spaces between the drops on the surface of the carton in the cross direction i.e., the direction perpendicular to the scanning direction, which interferes with the accuracy of the bar code readings.

SUMMARY OF THE INVENTION

Accordingly, it is an object of the present invention to provide an arrangement for printing bar codes on cartons which overcomes the disadvantages of the prior art.

Another object of the invention is to provide a hot melt ink jet printing method and arrangement for printing bar codes on cartons with improved quality.

These and other objects of the invention are attained by elevating the temperature of a selected portion of a carton surface to a temperature which is above ambient temperature by a predetermined temperature difference with respect to the solidification temperature of a hot melt ink and prior to such heating or immediately thereafter printing a bar code with the hot melt ink on the selected portion of the surface. In a preferred arrangement, the surface portion of the carton is heated to a temperature which is above the ambient temperature by an amount equal to about 40% to 100%, preferably about 50% to 90%, and desirably about 60% to 80%, of the difference between the ambient temperature and the solidification temperature of the ink.

The selected portion of the carton surface may be heated before or after bar code printing, for example, by contact with a heated surface, by hot air directed against the carton surface, or by radiant heating from heat lamps or the like. Preferably the temperature of the carton surface is detected before and after heating and the rate of heat application is controlled in accordance with the detected temperatures.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
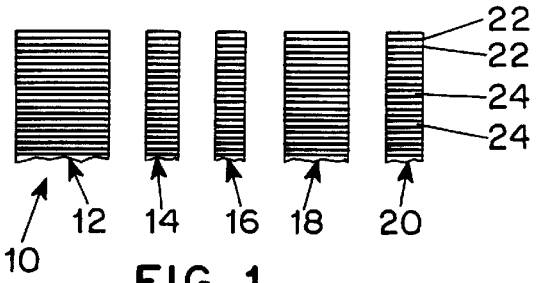
FIG. 1 is an enlarged fragmentary view showing a portion of a bar code printed on a carton surface with hot melt ink applied from a low resolution ink jet printer.

FIG. 1 is magnified view showing a portion of a bar code 10 printed with hot melt ink on the surface of a carton using a low resolution ink jet printer, e.g. one providing a resolution in the cross direction of less than about 200 dpi. Hot melt ink is preferable for bar code printing on cartons because it is easier to produce defined image edges, i.e., it does not bleed, permits good quality character printing in addition to the bar code printing, and is virtually independent of substrate properties. The ink jet printer may be of a conventional type such as disclosed in the Brooks et al. U.S. Pat. No. 5, 489,925, having a resolution of around 90 dots per inch. Each of the bars 12, 14, 16, 18 and 20 of the bar code image 10 shown in FIG. 1 consists of parallel image lines 22 separated by spaces 24. The result, when scanned by a bar code reader, is an overall gray image with ragged edges tending to cause erratic bar code reading.

Figure 2:
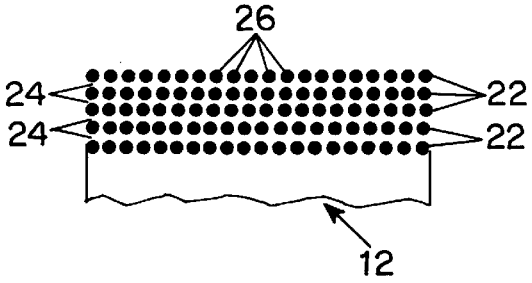
FIG. 2 is further enlarged fragmentary view showing a portion of one of the printed bars of the bar code of FIG. 1, illustrating the individual ink drops.

FIG. 2 illustrates the image of the bar 12 showing each of the separate solidified hot melt ink drops 26 deposited in each of the lines 22. Typically, with existing low resolution printheads, the hot melt drop sizes are around 0.003 inches when deposited on self-supporting substrates such as the surfaces of boxes or cartons at room temperature. Normally, the hot melt ink drops impact the box at a temperature of about 120° C. and freeze at about 90° C., and the box surface is at about 20° C. which serves as a driving force to cool the ink drops 26 before they can spread to fill the spaces between the lines 22.

Figure 3:
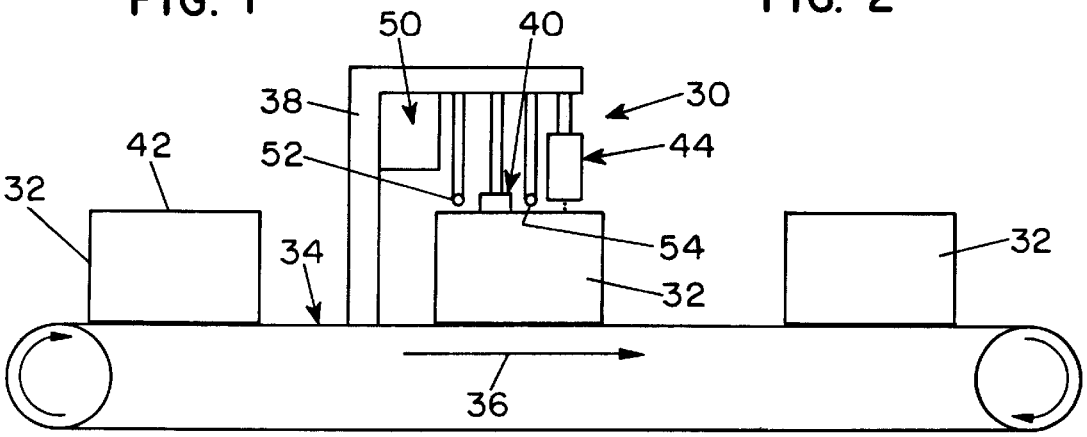
FIG. 3 is a schematic side view illustrating a representative embodiment of an arrangement for printing bar codes on cartons with hot melt ink in accordance with a representative embodiment of the invention.

In order to overcome this problem in accordance with the invention, a hot melt ink jet printing arrangement 30, shown in FIG. 3, is arranged to print bar codes on cartons 32 carried by a conveyor 34 in the direction of the arrow 36. The printing arrangement 30, which is supported on a mount 38, includes a heating member 40 which engages the top surfaces 42 of the boxes 32 in succession as they move in the direction of the arrow 36, along with a hot melt ink jet printer 44 arranged to print a bar code on the surface 42 immediately after the heater has heated the carton surface. The printer 44 may, for example, be of the type described in the Brooks et al. U.S. Pat. No. 5,489,925, the disclosure of which is incorporated herein by reference. If desired, the cartons 32 may be conveyed in the opposite direction from that indicated by the arrow 36 so that the carton surface is heated after the bar code has been printed.

A control unit 50 is arranged to control the temperature of the heater 40 in accordance with the ambient temperature and the solidification temperature of the hot melt ink used in the ink jet printer 44, and preferably is arranged to heat the carton surface 42 to a temperature which is above ambient temperature by an amount equal to about 40% to 100%, preferably 50% to 90%, and desirably 60% to 80%, of the difference between ambient temperature and the solidification temperature of the ink.

A temperature sensor 52 detects the temperature of the carton surface 42 before it is detected by the heater 40 i.e., the ambient temperature of the carton is heated before printing, and another temperature sensor 54 detects the temperature of the carton surface 42 after heating by the heating element 40 and immediately before the bar code is printed by the printer 44. The sensors 52 and 54 transmit corresponding signals to the control unit 50 to provide data from which the control unit controls the temperature of the heater 40 so as to cause the carton surface to be at the desired temperature level when the bar code is applied by the printer 44. With this arrangement, the desired temperature of the carton surface 42 can be achieved regardless of the level of the ambient temperature and of the rate of motion of the cartons 32 past the printer.

If the carton surface is heated immediately after the bar code has been printed, the surface temperature will be higher than ambient temperature because of the presence of the molten hot melt ink. Nevertheless, the same elevation in carton surface temperature may be appropriate in order to cause the ink drops to coalesce and produce complete coverage in the manner described hereinafter.

Figure 4:
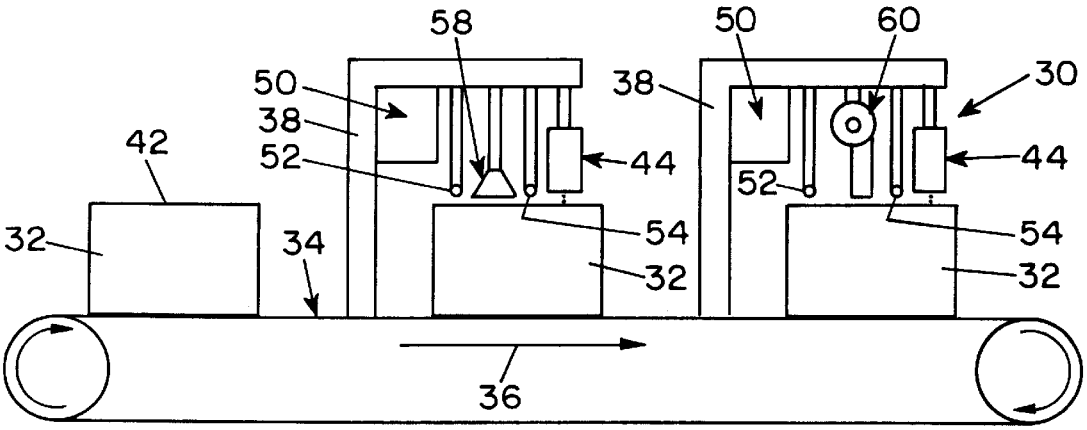
FIG. 4 is a schematic view similar to FIG. 3 illustrating other representative embodiments of the invention.

Instead of using the heating member 40 which engages the surface of the cartons, alternative carton surface heating arrangements may be used as shown in FIG. 4. In this illustration which is otherwise the same as the arrangement in FIG. 3, a variable intensity heat lamp 58, or a hot air source such as a conventional hair dryer 60, is used in place of the heating member 40 of FIG. 3 to heat the carton surface.

Figure 5:
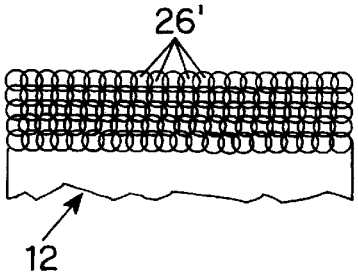
FIG. 5 is a an enlarged view similar to FIG. 2 illustrating the sizes of the ink drops in a bar of a bar code printed with hot melt ink in accordance with the invention.
Figure 6:
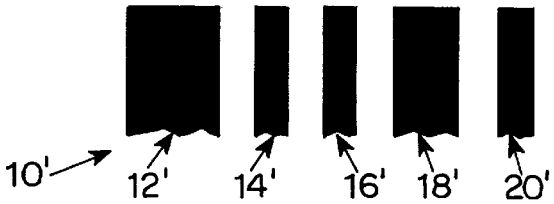
FIG. 6 is a view similar to FIG. 1 illustrating a portion of a bar code printed in accordance with the invention.

FIG. 5 is a magnified view similar to FIG. 2, illustrating the enlarged diameters of the ink drops 26' in the bar 12 after controlled heating of the carton surface 42 to an elevated temperature has caused the drops to flow until they coalesce before they are solidified. As shown in FIG. 5, the enlarged diameters 26' of the drops in the bar 12 overlap sufficiently so as to completely cover the portion of the carton surface where the bar code is being printed. The resulting bar code is shown in FIG. 6, which is similar to FIG. 2 but provides complete coverage of the carton surface regions where solid black bars 12', 14', 16', 18' and 20' have been printed. In addition, the controlled heating of the carton surface permits the ink to penetrate further into the surface, thereby improving durability of the bar code image, and reduces the amount of hot melt ink needed to achieve the full coverage required for solid bars in a bar code.

Although the invention has been described herein with reference to specific embodiments, many modifications and variations therein will readily occur to those skilled in the art. For example, instead of moving cartons in a conveyor past a fixed heater and printer, a heater and printer could be moved with respect to stationary cartons. Accordingly, all such variations and modifications are included within the intended scope of the invention.

I claim:

1. A method for printing bar codes on the surface of a carton comprising:

providing relative motion of a carton having a selected surface portion with respect to a low resolution hot melt ink jet printer facing the selected surface portion and arranged to print bar codes thereon in which the spacing between ink drops is such that adjacent printed ink drops do not normally coalesce before solidification;

heating the selected surface portion of a carton to a temperature above ambient temperature by a heater facing the selected surface portion; and printing a low resolution bar code on the selected surface portion of the carton using hot melt ink by the low resolution printer facing the selected surface portion.

2. A method according to claim 1 wherein the heating step takes place prior to the printing step.

3. A method according to claim 1 wherein the printing step takes place prior to the heating step.

4. A method according to claim 1 including detecting the temperature of the selected surface portion of the carton after heating; and controlling the application of heat to the selected surface portion in accordance with the difference between ambient temperature and the detected temperature.

5. A method according to claim 1 including detecting the temperature of the selected surface portion prior to heating to determine ambient temperature.

6. A method according to claim 1 wherein the printing of the bar code is carried out with a printer providing a resolution of no more than about 200 dots per inch in a direction perpendicular to the direction of relative motion of a carton with respect to the printer.

7. A method according to claim 1 including the step of conveying a carton past a fixed heater and a fixed hot melt ink jet printer both facing the selected surface portion during the heating and printing steps.

8. A method according to claim 1 including the step of heating the surface of the carton to a temperature which is above ambient temperature by an amount equal to about 40% to 100% of the difference between the ambient temperature and the solidification temperature of the hot melt ink with which the bar code is printed.

9. A method according to claim 8 including heating the carton surface to a temperature which is above ambient temperature by an amount equal to about 50% to 90% of the difference between ambient temperature and the solidification temperature of the ink with which the bar code is printed.

10. A method according to claim 8 including heating the selected surface portion of the carton to a temperature which is above ambient temperature by an amount equal to about 60% to 80% of the difference between ambient temperature and the solidifaction temperature of the ink with which the bar code is printed.

11. A hot melt ink jet printing arrangement comprising:

a low resolution hot melt ink jet printer facing a selected surface portion of a carton in which the spacing between ink drops is such that adjacent printed ink drops do not normally coalesce before solidification and arranged to print a bar code on the selected surface portion of a carton;

a heater facing the selected surface portion and arranged to apply heat to the selected surface portion of a carton; and means for providing relative motion between a carton and the heater and printer in succession to cause the selected surface portion to be elevated to a temperature which causes the hot melt ink drops of a printed bar code to coalesce before solidification on the select surface portion of the carton.

12. An arrangement according to claim 11 wherein the means for providing relative motion causes the temperature of the selected surface portion to be elevated before a bar code is printed on the surface of the carton.

13. An arrangement according to claim 11 wherein the means for providing relative motion causes the temperature of the selected surface portion to be elevated after a bar code is printed on the surface of the carton.

14. An arrangement according to claim 11 including a temperature detector positioned between the heater and the printer for detecting the temperature of the selected surface portion between the heater and the printer.

15. An arrangement according to claim 11 wherein the means for providing relative motion comprises a conveyor for conveying cartons on which bar codes are to be printed past the heater and then the printer in succession.

16. An arrangement according to claim 11 wherein the means for providing relative motion comprises a conveyor for conveying cartons on which bar codes are to be printed past the printer and then the heater in succession.

17. An arrangement according to claim 11 including a temperature detector for detecting the temperature of the selected surface portion of the carton prior to heating.

18. An arrangement according to claim 17 including control means for controlling the temperature of the selected surface portion of the carton after heating in accordance with the detected temperature and the solidification temperature of the hot melt ink used in the printer.

19. An arrangement according to claim 11 including a control unit for controlling the heater to heat the selected surface portion of the carton to a temperature which is above ambient temperature by an amount equal to about 40% to 100% of the difference between ambient temperature and the solidification temperature of the hot melt ink used in the printer.

20. An arrangement according to claim 19 wherein the control unit controls the heater to heat the selected surface portion of the carton to a temperature which is above ambient temperature by an amount equal to about 50% to 90% of the difference between ambient temperature and the solidification temperature of the hot melt ink used in the printer.

21. An arrangement according to claim 20 wherein the control unit controls the heater to heat the selected surface portion of the carton to a temperature which above ambient temperature by an amount equal to about 60% to 80% of the difference between ambient temperature and the solidification temperature of the hot melt ink used in the printer.

22. An arrangement according to claim 11 wherein the solidification temperature of the ink is about 90° C. and the heater heats the selected surface portion of the carton to a temperature of about 60° C.

* * * * *

UNITED STATES PATENT AND TRADEMARK OFFICE

CERTIFICATE OF CORRECTION

PATENT NO. : 6,293,638 B1
DATED : September 25, 2001
INVENTOR(S) : Marlene M. McDonald It is certified that error appears in the above-identified patent and that said Letters Patent is hereby corrected as shown below:

Title page,
Item [56], References Cited, U.S. PATENT DOCUMENTS "5,793,329 * 8/1998 Okada" should read -- 5,797,329-- * 8/1998 Okada --.

Column 2,
Line 27, "is further" should read -- is a further --.

Column 5,
Line 5, "solidifaction" should read -- solidification --.

Signed and Sealed this

Ninth Day of July, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,293,638 B1
DATED : September 25, 2001
INVENTOR(S) : Marlene M. McDonald It is certified that error appears in the above-identified patent and that said Letters Patent is hereby corrected as shown below:

Column 4,
Line 23, "portion." should read -- portion, wherein heating the selected surface portion of the carton causes the hot melt ink drops of the printed bar code to coalesce before solidification on the selected surface portion of the carton. --.

Signed and Sealed this

Eighth Day of October, 2002

*Attest:*

*Attesting Officer*

JAMES E. ROGAN
*Director of the United States Patent and Trademark Office*